US011008522B2

(12) United States Patent
Rankin et al.

(10) Patent No.: US 11,008,522 B2
(45) Date of Patent: May 18, 2021

(54) CATALYTIC CAUSTIC DESULFONYLATION

(71) Applicants: Auterra, Inc., Schenectady, NY (US); Cenovus Energy Inc., Calgary (CA)

(72) Inventors: Jonathan Rankin, Galway, NY (US); Sarah Briggs, Colonie, NY (US)

(73) Assignees: AUTERRA, INC., Schenectady, NY (US); CENOVUS ENERGY INC., Calgary (CA)

( * ) Notice: Subject to any disclaimer, the term of this patent is extended or adjusted under 35 U.S.C. 154(b) by 0 days.

(21) Appl. No.: 16/599,622

(22) Filed: Oct. 11, 2019

(65) Prior Publication Data

US 2020/0040264 A1 Feb. 6, 2020

Related U.S. Application Data

(62) Division of application No. 15/451,981, filed on Mar. 7, 2017, now Pat. No. 10,450,516.

(Continued)

(51) Int. Cl.
*C10G 45/04* (2006.01)

(52) U.S. Cl.
CPC ..... *C10G 45/04* (2013.01); *C10G 2300/202* (2013.01)

(58) Field of Classification Search
CPC ..... C10G 27/00; C10G 27/10; C10G 45/02; C10G 45/04; C10G 45/22; C10G 2300/202; B01J 3/04; B01J 8/008; B01J 8/02

See application file for complete search history.

(56) References Cited

U.S. PATENT DOCUMENTS 1,796,621 A 3/1931 Ramage
2,110,283 A 3/1938 Archibald (Continued)

FOREIGN PATENT DOCUMENTS

CN 101161788 A 4/2008
FR 827345 A 4/1938

(Continued)

OTHER PUBLICATIONS

Aida, Tetsuo, et al. Development of an Efficient Coal-Desulfurization process: "Oxy-Alkalinolysis". Technical Report Resource Conference: American Chemical Society symposium on coal liquefaction, pp. 328-334. Kansas City, MO USA. Published Sep. 1, 1982 Ames Lab., IA (USA); Advanced Fuel Research, Inc., East Hartford, CT (USA).

(Continued)

*Primary Examiner* — Prem C Singh
*Assistant Examiner* — Brandi M Doyle
(74) *Attorney, Agent, or Firm* — Schmeiser, Olsen & Watts, LLP

(57) ABSTRACT

A caustic desulfonylation method and system comprising a reactor vessel with a solid carbonaceous selectivity promoter provided therein, a liquid feed input of the reactor vessel configured to receive a source of caustic, a hydrocarbon feed comprising oxidized sulfur containing compounds and a gas feed input of the reactor vessel configured to receive a source of hydrogen. The caustic desulfonylation method and system further includes an output of the reactor vessel releasing the caustic and an upgraded hydrocarbon product with sulfur content less than the sulfur content of the hydrocarbon feed received by the liquid feed of the reactor vessel.

15 Claims, 2 Drawing Sheets

Related U.S. Application Data

(60) Provisional application No. 62/305,039, filed on Mar. 8, 2016.

(56) References Cited

U.S. PATENT DOCUMENTS

| | | | |
|---|---|---|---|
| 2,764,525 | A | 9/1956 | Porter et al. |
| 2,771,402 | A | 11/1956 | Birch et al. |
| 2,789,134 | A | 4/1957 | Nelson et al. |
| 2,794,770 | A | 6/1957 | Alderson et al. |
| 2,910,434 | A | 10/1959 | Hess et al. |
| 2,987,740 | A | 6/1961 | Earnhardt |
| 3,136,714 | A | 6/1964 | Gibson et al. |
| 3,164,545 | A | 1/1965 | Mattox |
| 3,505,210 | A | 4/1970 | Wallace et al. |
| 3,558,747 | A | 1/1971 | Meltsner |
| 3,565,793 | A | 2/1971 | Herbstman et al. |
| 3,668,117 | A | 6/1972 | Patel et al. |
| 3,819,509 | A | 6/1974 | Wolk et al. |
| 3,847,797 | A | 11/1974 | Pasternak et al. |
| 3,873,587 | A | 3/1975 | Rosenthal et al. |
| 3,954,914 | A | 3/1976 | Yoo et al. |
| 3,948,759 | A | 4/1976 | King et al. |
| 3,957,620 | A | 5/1976 | Fukui et al. |
| 3,960,706 | A | 6/1976 | McCollum et al. |
| 3,960,708 | A | 6/1976 | McCollum et al. |
| 3,964,995 | A | 6/1976 | Wolk et al. |
| 4,003,823 | A | 1/1977 | Baird, Jr. et al. |
| 4,088,569 | A | 5/1978 | Douglas |
| 4,119,528 | A | 10/1978 | Baird, Jr. et al. |
| 4,127,470 | A | 11/1978 | Baird, Jr. et al. |
| 4,192,736 | A | 3/1980 | Kluksdahl |
| 4,224,140 | A | 9/1980 | Fujimori et al. |
| 4,374,949 | A | 2/1983 | Massey et al. |
| 4,437,980 | A | 3/1984 | Heredy et al. |
| 4,444,655 | A | 4/1984 | Shiroto et al. |
| 4,591,426 | A | 5/1986 | Krasuk et al. |
| 4,645,589 | A | 2/1987 | Krambeck et al. |
| 4,665,261 | A | 5/1987 | Mazurek |
| 4,923,682 | A | 5/1990 | Roberts et al. |
| 5,064,523 | A | 11/1991 | Kretschmar et al. |
| 5,089,149 | A | 2/1992 | Ridland et al. |
| 5,166,118 | A | 11/1992 | Kretschmar et al. |
| 5,282,960 | A | 2/1994 | Pillon et al. |
| 5,288,681 | A | 2/1994 | Gatsis |
| 5,616,751 | A | 4/1997 | Nakai et al. |
| 5,637,739 | A | 6/1997 | Jacobsen et al. |
| 6,087,662 | A | 7/2000 | Wilt et al. |
| 6,160,193 | A | 12/2000 | Gore |
| 6,245,223 | B1 | 6/2001 | Gorbaty et al. |
| 6,342,191 | B1 | 1/2002 | Kepner et al. |
| 6,368,495 | B1 | 4/2002 | Kocal et al. |
| 6,403,526 | B1 | 6/2002 | Lussier et al. |
| 6,406,616 | B1 | 6/2002 | Rappas et al. |
| 6,471,852 | B1 | 10/2002 | Mark et al. |
| 6,544,409 | B2 | 4/2003 | De Souza |
| 6,547,957 | B1 | 4/2003 | Sudhakar et al. |
| 6,579,472 | B2 | 6/2003 | Chung et al. |
| 6,638,419 | B1 | 10/2003 | Da Silva et al. |
| 6,673,236 | B2 | 1/2004 | Stanciulescu et al. |
| 6,846,406 | B2 | 1/2005 | Canos et al. |
| 7,144,499 | B2 | 12/2006 | Han et al. |
| 7,153,414 | B2 | 12/2006 | De Souza |
| 7,179,368 | B2 | 2/2007 | Rabion et al. |
| 7,314,545 | B2 | 1/2008 | Karas et al. |
| 7,371,318 | B2 | 5/2008 | Corma Canos et al. |
| 7,374,666 | B2 | 5/2008 | Wachs |
| 7,591,944 | B2 | 9/2009 | Carnell et al. |
| 7,598,426 | B2 | 10/2009 | Fang et al. |
| 7,648,625 | B2 | 1/2010 | Bhan et al. |
| 7,678,264 | B2 | 3/2010 | Bhan |
| 7,749,374 | B2 | 7/2010 | Bhan et al. |
| 7,790,021 | B2 | 9/2010 | Kocal et al. |
| 7,875,185 | B2 | 1/2011 | Zhang |
| 7,918,992 | B2 | 4/2011 | Bhan |
| 8,021,540 | B2 | 9/2011 | Toida |
| 8,088,706 | B2 | 1/2012 | Domokos et al. |
| 8,187,991 | B2 | 5/2012 | Osaheni et al. |
| 8,197,671 | B2 | 6/2012 | Rankin et al. |
| 8,241,490 | B2 | 8/2012 | Litz et al. |
| 8,283,498 | B2 | 10/2012 | Litz et al. |
| 8,298,404 | B2 | 10/2012 | Litz et al. |
| 8,372,777 | B2 | 2/2013 | Bhan et al. |
| 8,394,261 | B2 | 3/2013 | Litz et al. |
| 8,409,541 | B2 | 4/2013 | Reynolds et al. |
| 8,444,061 | B2 | 5/2013 | Van Den Berg et al. |
| 8,450,538 | B2 | 5/2013 | Bhan et al. |
| 8,481,450 | B2 | 7/2013 | Bhan |
| 8,487,155 | B2 | 7/2013 | Boateng et al. |
| 8,492,599 | B2 | 7/2013 | Bhan et al. |
| 8,530,370 | B2 | 9/2013 | Donaho et al. |
| 8,562,817 | B2 | 10/2013 | Milam et al. |
| 8,562,818 | B2 | 10/2013 | Milam et al. |
| 8,597,608 | B2 | 12/2013 | Reynolds et al. |
| 8,608,946 | B2 | 12/2013 | Bhan et al. |
| 8,673,132 | B2 | 3/2014 | Leta et al. |
| 8,696,890 | B2 | 4/2014 | Soto et al. |
| 8,703,015 | B2 | 4/2014 | Chen et al. |
| 8,764,973 | B2 | 7/2014 | Litz et al. |
| 8,877,013 | B2 | 11/2014 | Litz et al. |
| 8,877,043 | B2 | 11/2014 | Litz et al. |
| 8,894,843 | B2 | 11/2014 | Rankin et al. |
| 8,894,845 | B2 | 11/2014 | Vann et al. |
| 8,961,779 | B2 | 2/2015 | Litz et al. |
| 9,061,273 | B2 | 6/2015 | Litz et al. |
| 9,206,359 | B2 | 12/2015 | Litz et al. |
| 9,512,151 | B2 | 12/2016 | Litz et al. |
| 9,828,557 | B2 | 11/2017 | Rankin et al. |
| 2002/0177522 | A1 | 11/2002 | Alexander, IV et al. |
| 2002/0189975 | A1 | 12/2002 | De Souza |
| 2003/0000867 | A1 | 1/2003 | Reynolds |
| 2003/0024432 | A1 | 2/2003 | Chung et al. |
| 2003/0149317 | A1 | 8/2003 | Rendina |
| 2004/0108252 | A1 | 6/2004 | De Souza |
| 2004/0178121 | A1 | 9/2004 | Leyshon et al. |
| 2004/0178122 | A1 | 9/2004 | Karas et al. |
| 2004/0219116 | A1 | 11/2004 | Reynders et al. |
| 2004/0222134 | A1 | 11/2004 | de Souza |
| 2004/0238410 | A1 | 12/2004 | Inoue et al. |
| 2005/0014850 | A1 | 1/2005 | Hu |
| 2005/0023188 | A1 | 2/2005 | Connor |
| 2006/0011510 | A1 | 1/2006 | Toshima et al. |
| 2006/0144793 | A1 | 7/2006 | Dadachov |
| 2006/0154814 | A1 | 7/2006 | Zanibelli et al. |
| 2006/0180501 | A1 | 8/2006 | Da Silva et al. |
| 2006/0231456 | A1 | 10/2006 | Bhan |
| 2006/0231457 | A1 | 10/2006 | Bhan |
| 2006/0234876 | A1 | 10/2006 | Bhan |
| 2007/0000810 | A1 | 1/2007 | Bhan et al. |
| 2007/0051667 | A1 | 3/2007 | Martinie et al. |
| 2007/0256980 | A1 | 11/2007 | Krogue et al. |
| 2007/0295646 | A1 | 12/2007 | Bhan et al. |
| 2008/0083650 | A1 | 4/2008 | Bhan et al. |
| 2008/0087575 | A1 | 4/2008 | Bhan et al. |
| 2008/0121565 | A1 | 5/2008 | Yoo et al. |
| 2008/0135449 | A1 | 6/2008 | Bhan et al. |
| 2008/0308463 | A1 | 12/2008 | Keckler et al. |
| 2009/0065399 | A1 | 3/2009 | Kocal et al. |
| 2009/0188836 | A1 | 7/2009 | Bhan et al. |
| 2010/0055005 | A1 | 3/2010 | Bhan et al. |
| 2010/0098602 | A1 | 4/2010 | Bhan et al. |
| 2011/0000823 | A1 | 1/2011 | Hamad et al. |
| 2011/0011771 | A1 | 1/2011 | Litz et al. |
| 2011/0031164 | A1 | 2/2011 | Litz et al. |
| 2011/0108464 | A1 | 5/2011 | Rankin et al. |
| 2011/0119988 | A1 | 5/2011 | Litz et al. |
| 2011/0147274 | A1 | 6/2011 | Soto et al. |
| 2011/0178346 | A1 | 7/2011 | Milam et al. |
| 2011/0192762 | A1 | 8/2011 | Wellington et al. |
| 2011/0210043 | A1 | 9/2011 | Wellington et al. |
| 2011/0294657 | A1 | 12/2011 | Soled et al. |
| 2012/0028341 | A1 | 2/2012 | Heerze |
| 2012/0055843 | A1 | 3/2012 | Bourane et al. |
| 2012/0055844 | A1 | 3/2012 | Bourane et al. |
| 2012/0055845 | A1 | 3/2012 | Bourane et al. |

(56) References Cited

U.S. PATENT DOCUMENTS

| | | | | |
|---|---|---|---|---|
| 2012/0055849 | A1 | 3/2012 | Bourane et al. | |
| 2012/0067777 | A1 | 3/2012 | Litz et al. | |
| 2012/0067783 | A1 | 3/2012 | Kaplan et al. | |
| 2012/0074040 | A1 | 3/2012 | Koseoglu et al. | |
| 2012/0149961 | A1 | 6/2012 | Krupa et al. | |
| 2012/0152804 | A1 | 6/2012 | Koseoglu et al. | |
| 2012/0285864 | A1 | 11/2012 | Rankin et al. | |
| 2012/0285866 | A1 | 11/2012 | Litz et al. | |
| 2013/0015104 | A1 | 1/2013 | Al-Hajji et al. | |
| 2013/0026062 | A1 | 1/2013 | Al-Shahrani et al. | |
| 2013/0026071 | A1 | 1/2013 | Koseoglu et al. | |
| 2013/0026075 | A1 | 1/2013 | Koseoglu et al. | |
| 2013/0028822 | A1 | 1/2013 | Bourane et al. | |
| 2013/0030236 | A1 | 1/2013 | Koseoglu et al. | |
| 2013/0048543 | A1 | 2/2013 | Litz et al. | |
| 2013/0075305 | A1 | 3/2013 | Al-Shafei et al. | |
| 2013/0130892 | A1 | 5/2013 | Litz et al. | |
| 2013/0171039 | A1 | 7/2013 | Graham et al. | |
| 2013/0185044 | A1 | 7/2013 | Chen et al. | |
| 2013/0313161 | A1* | 11/2013 | Dindi | C10G 65/02 208/57 |
| 2013/0315793 | A1 | 11/2013 | Koseoglu et al. | |
| 2013/0334103 | A1 | 12/2013 | Bourane et al. | |
| 2014/0024569 | A1 | 1/2014 | Bera et al. | |
| 2014/0030171 | A1 | 1/2014 | Mohamadalizadeh et al. | |
| 2014/0131256 | A1 | 5/2014 | Litz et al. | |
| 2014/0151305 | A1 | 6/2014 | Schrage et al. | |
| 2014/0216984 | A1 | 8/2014 | Litz et al. | |
| 2014/0291199 | A1 | 10/2014 | Litz et al. | |
| 2014/0339136 | A1 | 11/2014 | Litz et al. | |
| 2015/0184086 | A1 | 7/2015 | Rankin et al. | |
| 2015/0337208 | A1 | 11/2015 | Litz et al. | |
| 2015/0337220 | A1 | 11/2015 | Litz et al. | |
| 2016/0281003 | A1 | 9/2016 | Litz et al. | |
| 2017/0260462 | A1 | 9/2017 | Rankin et al. | |
| 2019/0055483 | A1* | 2/2019 | Bafna | C10G 67/00 |

FOREIGN PATENT DOCUMENTS

| | | | |
|---|---|---|---|
| FR | 1299736 | A | 7/1962 |
| FR | 1472280 | A | 3/1967 |
| KR | 100733571 | B1 | 6/2007 |
| MX | 171286 | B | 10/1993 |
| RU | 2087520 | C1 | 8/1997 |
| RU | 2146693 | C1 | 3/2000 |
| RU | 2177494 | C1 | 12/2001 |
| WO | 0181715 | A2 | 11/2001 |
| WO | 2006093799 | A2 | 9/2006 |
| WO | 2008153633 | A2 | 12/2008 |
| WO | 2009120238 | A1 | 10/2009 |
| WO | 2012039910 | A1 | 3/2012 |
| WO | 2012051009 | A1 | 4/2012 |
| WO | 2013188144 | A1 | 12/2013 |
| WO | 2014018082 | A1 | 1/2014 |
| WO | 2014095813 | A1 | 6/2014 |
| WO | 2016154529 | A1 | 9/2016 |

OTHER PUBLICATIONS

Aida, Tetsuo, et al. Reaction of Dibenzothiophene Sulfone with Alkoxides. Tetrahedron Letters (1983), vol. 24, No. 34, pp. 3543-3546. USA.

Akasaka, Takeshi,e t al. Singlet Oxygen Oxidation of Organophosphorus Compounds: Cooxidation of Olefin with Phosphadioxirane. Quimica Nova, 1993, 16, pp. 325-327. No published date or location.

Ali, Mohammed Hashmat, et al. Ceric Ammonium Nitrate Catalyzed Oxidation of Sulfides to Sulfoxides. Synthesis, 2007, No. 22, pp. 3507-3511. Published on Web Oct. 16, 2007.

Drago, Carmelo, et al. Vanadium-Catalyzed Sulfur Oxidation/Kinetic Resolution in the Synthesis of Enantiomerically Pure Alkyl Aryl Sulfoxides. Agnew. Chem. Int. Ed, 2005, 44, pp. 7221-7223. Published on Web Oct. 17, 2005.

Egami, Hiromichi, et al. Fe(salan)-Catalyzed Asymmetric Oxidation of Sulfides with Hydrogen Peroxide in Water. J. Am. Chem. Soc., 2007, vol. 129, No. 29, pp. 8940-8941. Published on Web Jun. 29, 2007.

El Nady, M. M. et al. (2013). Journal of Chemical and Engineering Data, 1, 1-7.

Energy Intelligence Group. (2007). "The Crude Oils and their Key Characteristics," 7 pgs. (Available at http://www.energyintel.com/pages/eig_article.aspx?DocId=200017).

http:/ /evans.rc.fas.harvard.edu/pdf/evans _pKa table. Pdf.

Imada, Yasushi, et al. Flavin Catalyzed Oxidations of Sulfides and Amines with Molecular Oxygen. J. Am Chem. Soc., 2003, vol. 125, No. 10, pp. 2868-2869. Published on Web Feb. 12, 2003.

Jain, Suman L., et al. Rehenium-Catalyzed Highly Efficient Oxidations of Tertiary Nitrogen Compounds to N-Oxides Using Sodium Percarbonate as Oxygen Source. Synlett, 2006, No. 16, pp. 2661-2663. Published on Web Sep. 22, 2006.

Jana, Nirmal K., et al. Phase-Vanishing Methodology for Efficient Bromination, Alkylation, Epoxidation, and Oxidation Reactions of Organic Substrates. Organic Letters, 2003, vol. 5, No. 21, pp. 3787-3790. Published on Web Sep. 16, 2003.

Jiang, Benpeng et al., ("Hydrothermal synthesis of rutile TiO2 nanoparticles using hydroxyl and carboxyl group-containing organics as modifiers." Materials Chemistry and Physics, pp. 231-235), 2006. (6928UAE Exam Report).

Karimi, Babak, et al. Selective Oxidation of Sulfides to Sulfoxides Using 30% Hydrogen Peroxide Catalyzed with a Recoverable Silica-Based Tungstate Interphase Catalyst. Organic Letters, 2005, vol. 7, No. 4, pp. 625-628. Published on Web Jan. 25, 2005.

Khodaei, Mohammad Mehdi, et al. H2O2/Tf2O System: An Efficient Oxidizing Reagent for Selective Oxidation of Sulfanes. Synthesis, 2008; No. 11, pp. 1682-1684. Published on Web Apr. 11, 2008.

Kim, Sung Soo, et al. A Mild and Highly Efficient Oxidation of Sulfide to Sulfoxides with Periodic Acid Catalyzed by FeCl3. Synthesis, 2002, No. 17, pp. 2484-2486. Published USA Feb. 12, 2002.

Matteucci, Mizio, et al. Mild and Highly Chemoselective Oxidation of Thioethers Mediated by Sc(OTf)3. Organic Letters, 2003, vol. 5, No. 3, 235-237. Published on Web Jan. 11, 2003.

Mba, Myriam, et al. C3-Symmetric Ti(IV) Triphenolate Amino Complexes as Sulfoxidation Catalysts with Aqueous Hydrogen Peroxide. Organic Letters, 2007, vol. 9, No. 1, pp. 21-24. Published on Web Dec. 9, 2006.

McKillop, Alexander, et al. Further Functional-Group Oxidations Using Sodium Perborate. Tetrahedron, vol. 45, No. 11, pp. 3299 to 3306, 1989. Published in Great Britain.

Milner, O.I., et al. Determination of Trace Materials in Crudes and Other Petroleum Oils. Analytical Chemistry, vol. 24, No. 11. Published Nov. 1952, USA.

Oviedo, Alberto, et al. Deoxydesulfurization of sulfones derived from dibenzothiophene using nickel compounds. Journal of Molecular Catalysis A: Chemical, (2008) 293, pp. 65-71. USA.

Pyatnaskii, I.V., et al., "Photometric investigation of Fe(II) and Ti(IV) complexes and mannitol and glycerol in solutios," CA, Chemical Abstracts Service, Columbus, Ohio, US, (1963), (Russian Edition), Database accession No. 59:33671, URL: STN, XP002649502; Ukrainskii Khimicheskii Zhurnal, (1963), pp. 440-449 (English Translation of Abstract Only), 11 pages.

Qian, Weixing, et al. Efficient and Highly Selective Oxidation of Sulfides to Sulfoxides in the Presence of an Ionic Liquid Containing Hypervalent Iodine. Synlett, 2006, No. 5, pp. 709-712. Published on Web Mar. 9, 2006.

Ripin, D.H., et al., "pKa's of Inorganic and Oxo-Acids", [http://evans.harvard.edu/pdf/evans_pka_table.pdf]; published Apr. 11, 2005, accessed Apr. 29, 2013. 6 pages.

Shaabani, Ahmad, et al. Green oxidations. The use of potassium permanganate supported on manganese dioxide. Tetrahedron, 2004, 60, pp. 11415-11420. Published on Web Oct. 12, 2004.

Sun, Jiangtao, et al. Efficient Asymmetric Oxidation of Sulfides and Kinetic Resolution of Sulfoxides Catalyzed by a Vanadium-Salan System. J. Org. Chem., 2004, vol. 69, No. 24, pp. 8500-8503. Published on Web Oct. 28, 2004.

(56) References Cited

OTHER PUBLICATIONS

Varma, Rajender S., et al. The Urea-Hydrogen Peroxide Complex: Solid-State Oxidatives Protocols for Hydroxylated Aldehydes and Ketones (Dakin Reaction), Nitrites, Sulfides, and Nitrogen Heterocycles. Organic Letters, 1999, vol. 1, No. 2, pp. 189-191. Published on Web May 29, 1999.
Varma, Rajender S., et al. The Urea-Hydrogen Peroxide Complex: Solid-State Oxidative Protocols for Hydroxylated Aldehydes and Ketones (Dakin Reaction), Nitrites, Sulfides, and Nitrogen Heterocycles. Organic Letters, 1999, vol. 1, No. 2, pp. 189-191. Published on Web May 29, 1999.
Wozniak, Lucyna A., et al. Oxidation in Organophosphorus Chemistry: Potassium Peroxymonosulphate. Tetrahedron, 1999, 40, pp. 2637-2640. Accepted Feb. 3, 1999. No published date.
International Patent Application No. PCT/US2013/43843, International Search Report and the Written Opinion of the International Searching Authority dated Aug. 27, 2013, 7 pages.
Chinese Patent Application No. 201380015161.1, Office Action dated Nov. 16, 2015.
European Patent Application No. 13 803 981.3, Extended European Search Report dated Mar. 11, 2016, 10 pages.
European Patent Application No. 13 803 981.3, Office Action dated Dec. 6, 2016, 7 pages.
GCC Patent Application No. GC2013-24619, Examination Report dated Nov. 26, 2016, 4 pages.
Indian Patent Application No. 9011/CHENP/2014, Office Action dated Aug. 27, 2018.
Iraqi Patent Application No. 2013/188, Office Action dated Jul. 21, 2011.
Mexican Patent Application No. MX/a/2014/014432 , Office Action dated Jul. 31, 2017.
Russian Patent Application No. 2014152661/04, Search Report dated Apr. 25, 2017.
Canadian Patent Application No. 2,868,851, Office Action dated Jul. 9, 2019.
International Patent Application No. PCT/US2008/82095, International Search Report and the Written Opinion of the International Searching Authority, or the Declaration dated Mar. 20, 2009, 12 pages.
Australian Patent Application No. 2008353354, Office Action dated Mar. 23, 2013, 4 pages.
Canadian Patent Application No. 2,719,058, Office Action dated Dec. 31, 2014, 3 pages.
Canadian Patent Application No. 2,719,058, Office Action dated Jun. 19, 2015, 4 pages.
Canadian Patent Application No. 2,719,058, Office Action dated Jan. 11, 2016, 3 pages.
Canadian Patent Application No. 2,719,058, Office Action dated Aug. 9, 2016, 3 pages.
Chilean Patent Application No. 1040-2010, Office Action dated Mar. 3, 2014.
Chilean Patent Application No. 1040-2010, Office Action dated Oct. 3, 2014.
Chinese Patent Application No. 200880128410.7, Office Action dated Jan. 29, 2013.
Chinese Patent Application No. 200880128410.7, Office Action dated May 23, 2013.
Chinese Patent Application No. 200880128410.7, Office Action dated Dec. 3, 2011.
Egyptian Patent Application No. 2010/09/1614, Office Action dated Sep. 26, 2012.
Egyptian Patent Application No. 2010/09/1614, Office Action dated Feb. 3, 2011.
Egyptian Patent Application No. 2010/1614 D2, Office Action forwarded dated Feb. 2, 2014.
Egyptian Patent Application No. 2010/1614 D1, Office Action dated Dec. 30, 2013.
European Patent Application No. 08873622.8, Extended European Search Report dated Apr. 24, 2013, 8 pages.
GCC Patent Application No. GCC/P.2009/13131, Examination Report dated Apr. 17, 2014, 6 pages.
GCC Patent Application No. GCC/P.2009/13131, Examination Report dated Feb. 3, 2016, 9 pages.
GCC Patent Application No. GCC/P/2009/27433, Examination Report dated May 13, 2018, 5 pages.
Indian Patent Application No. 1992/MUMNP/2010, Office Action dated Mar. 31, 2015.
Indonesian Patent Application No. W00201003533, Office Action dated Jun. 16, 2014, 2 pages.
Iraqi Patent Application No. 285/2010, Office Action dated Feb. 24, 2013.
Iraqi Patent Application No. 285/2010, Office Action dated May 26, 2013.
Iraqi Patent Application No. 285/2010, Office Action dated Feb. 11, 2014.
Japanese Patent Application No. 2011-501781, Office Action dated Sep. 12, 2013, 4 pages.
International Patent Application No. PCT/US2011/50159, International Search Report and the Written Opinion of the International Searching Authority dated Jan. 12, 2012, 11 pages.
Examiner's Action in Canadian Patent Application No. 2,810,690 dated Apr. 8, 2018.
Office Action in Canadian Patent Application No. 2,810,690 dated Jul. 24, 2017.
Office Action in Indian Patent Application No. 1766/CHENP/2013 dated Jan. 25, 2018.
Office Action in Brazilian Patent Application No. BR 11 2013 006559-1 dated Jan. 28, 2019. 5 pages.
Office Action (dated Aug. 15, 2013) for U.S. Appl. No. 13/560,584, filed Jul. 27, 2012.
Office Action (dated Dec. 17, 2013) for U.S. Appl. No. 13/560,584, filed Jul. 27, 2012.
Office Action (dated Feb. 27, 2014) for U.S. Appl. No. 13/560,584, filed Jul. 12, 2012.
Notice of Allowance (dated Apr. 29, 2014) for U.S. Appl. No. 13/560,584, filed Jul. 12, 2012.
Office Action (dated Jun. 15, 2016) for U.S. Appl. No. 14/246,508, filed Apr. 7, 2014.
Office Action (dated Feb. 24, 2017) for U.S. Appl. No. 14/246,508, filed Apr. 7, 2014.
Office Action (dated Jan. 21, 2015) for U.S. Appl. No. 14/287,916, filed May 27, 2014.
Office Action (dated Jun. 19, 2015) for U.S. Appl. No. 14/287,916, filed May 27, 2014.
Notice of Allowance (dated Aug. 4, 2015) for U.S. Appl. No. 14/287,916, filed May 27, 2014.
Office Action (dated Apr. 22, 2016) for U.S. Appl. No. 14/286,342, filed May 23, 2014.
Office Action (dated Apr. 20, 2016) for U.S. Appl. No. 14/573,230, filed Dec. 17, 2014.
Restriction Requirement (dated Sep. 5, 2017) for U.S. Appl. No. 15/080,784, filed Mar. 25, 2016.
Ex Parte Quayle (dated Sep. 7, 2018) for U.S. Appl. No. 15/080,784, filed Mar. 25, 2016.
Notice of Allowance (dated Nov. 20, 2018) for U.S. Appl. No. 15/080,784, filed Mar. 25, 2016.
Notice of Allowance (dated Apr. 4, 2019) for U.S. Appl. No. 16/285,532, filed Mar. 26, 2019.
Restriction Requirement (dated Feb. 21, 2019) for U.S. Appl. No. 15/451,981, filed Mar. 7, 2017.
Notice of Allowance (dated Jun. 12, 2019) for U.S. Appl. No. 15/451,981, filed Mar. 7, 2017.
Notice of Allowance in Canadian Patent Application No. 2,810,690 dated Mar. 15, 2019.
Korean Office Action Translation for KR Appln. No. 2009-7024832.
Brazilian Patent Application No. 0809881-6, Office Action dated Jan. 15, 2019, 4 pages.
Bahrain Patent Application No. 107/2009, Office Action dated Nov. 22, 2018. 9 pages.
SCC Patent Application No. GC 2011-19492, Examination Report dated Dec. 29, 2015, 4 pages.

(56) References Cited

OTHER PUBLICATIONS

SCC Patent Application No. GC 2011-19492, Examination Report dated Aug. 24, 2017, 4 pages.
International Patent Application No. PCT/US2011/54840, International Search Report and the Written Opinion of the International Searching Authority dated Mar. 12, 2012, 8 pages.
International Patent Application No. PCT/US2011/70243, International Search Report and the Written Opinion of the International Searching Authority dated Feb. 25, 2013, 40 pages.
European Office Action for Application No. 11 833 137.0-1361, dated Aug. 13, 2015.
International Patent Application No. PCT/US15/32417, International Search Report and Written Opinion dated Aug. 5, 2015.
Office Action for Russian Application No. 2015105930/04, dated Oct. 17, 2016.
Office Action in Canadian Patent Application No. 2,808,640 dated Oct. 17, 2017, 3 pages.
Office Action in Indian Patent Application No. 1765/CHENP/2013 dated Feb. 9, 2018.
Mexican Patent Application No. MX/a/2015/000923 , Office Action dated Sep. 12, 2017. 4 pages.
Indian Patent Application No. 8430/CHENP/2014, Office Action dated Aug. 17, 2018, 6 pages.
Canadian Patent Application No. 2,879,626, Examination Search Report dated Dec. 31, 2018.
Canadian Patent Application No. 2,879,626, Examination Search Report dated Jan. 4, 2019.
International Patent Application No. PCT/US15/31461, International Search Report and Written Opinion dated Aug. 1, 2015.
International Patent Application No. PCT/US15/064587, International Search Report and Written Opinion dated Feb. 16, 2016.
International Patent Application No. PCT/US16/024201, International Search Report and Written Opinion dated Jun. 20, 2016.
Notice of Allowance for Canadian Appln No. 2,705,456, dated Sep. 17, 2015.
Notice of Allowance (dated Feb. 13, 2012) for U.S. Appl. No. 12/977,639, filed Dec. 23, 2010.
Office Action (dated Aug. 19, 2013) for U.S. Appl. No. 13/493,240, filed Jun. 11, 2012.
Office Action (dated Jan. 3, 2014) for U.S. Appl. No. 13/493,240, filed Jun. 11, 2012.
Office Action (dated Mar. 20, 2014) for U.S. Appl. No. 13/493,240, filed Jun. 11, 2012.
Notice of Allowance (dated Jul. 17, 2014) for U.S. Appl. No. 13/493,240, filed Jun. 11, 2012.
Office Action (dated Apr. 11, 2012) for U.S. Appl. No. 12/933,898, filed Sep. 22, 2010.
Office Action (dated Oct. 18, 2012) for U.S. Appl. No. 12/933,898, filed Sep. 22, 2010.
Notice of Allowance (dated Nov. 9, 2012) for U.S. Appl. No. 12/933,898, filed Sep. 22, 2010.
Office Action (dated Nov. 10, 2014) for U.S. Appl. No. 13/734,054, filed Jan. 4, 2013.
Notice of Allowance (dated Feb. 27, 2015) for U.S. Appl. No. 13/734,054, filed Jan. 4, 2013.
Notice of Allowance (dated Jul. 9, 2012) for U.S. Appl. No. 12/888,0489, filed Sep. 22, 2010.
Office Action (dated Jun. 6, 2013) for U.S. Appl. No. 13/660,371, filed Oct. 25, 2012.
Office Action (dated Nov. 12, 2013) for U.S. Appl. No. 13/660,371, filed Oct. 25, 2012.
Notice of Allowance (dated Jun. 24, 2014) for U.S. Appl. No. 13/660,371, filed Oct. 25, 2012.
Office Action (dated Jun. 25, 2014) for U.S. Appl. No. 14/246,597, filed Apr. 7, 2014.
Notice of Allowance (dated Aug. 14, 2014) for U.S. Appl. No. 14/246,597, filed Apr. 7, 2014.
Office Action (dated Jun. 19, 2014) for U.S. Appl. No. 14/159,833, filed Jan. 21, 2014.
Notice of Allowance (dated Oct. 27, 2014) for U.S. Appl. No. 14/159,833, filed Jan. 21, 2014.
Office Action (dated Feb. 22, 2017) for U.S. Appl. No. 14/629,169, filed Feb. 23, 2015.
Notice of Allowance (dated Jul. 21, 2017) or U.S. Appl. No. 14/629,169, filed Feb. 23, 2015.
Office Action (dated Mar. 20, 2012) for U.S. Appl. No. 12/598,474, filed Apr. 23, 2010.
Office Action (dated Oct. 15, 2012) for U.S. Appl. No. 12/598,474, filed Apr. 23, 2010.
Office Action (dated Sep. 11, 2014) for U.S. Appl. No. 12/598,474, filed Apr. 23, 2010.
Advisory Action (dated Dec. 10, 2014) for U.S. Appl. No. 12/598,474, filed Apr. 23, 2010.
Office Action (dated May 11, 2015) for U.S. Appl. No. 12/598,474, filed Apr. 23, 2010.
Office Action (dated Nov. 20, 2015) for U.S. Appl. No. 12/598,474, filed Apr. 23, 2010.
Final Office Action (dated May 6, 2016) for U.S. Appl. No. 12/598,474, filed Apr. 23, 2010.
Notice of Allowance (dated Aug. 9, 2016) for U.S. Appl. No. 12/698,474, filed Apr. 23, 2010.
Notice of Allowance (dated Feb. 13, 2012) for U.S. Appl. No. 12/904,446, filed Oct. 14, 2010.

* cited by examiner

CATALYTIC CAUSTIC DESULFONYLATION

CROSS REFERENCE TO RELATED APPLICATIONS

This application claims the priority and benefit of U.S. patent application Ser. No. 15/451,981 filed on Mar. 7, 2017, entitled "Catalytic Caustic Desulfonylation," which claims priority to U.S. Patent Application No. 62/305,039 filed on Mar. 8, 2016, entitled "Catalytic Caustic Desulfonylation," the disclosures of which are hereby incorporated by reference.

FIELD OF THE TECHNOLOGY

The following relates generally to methods and systems for performing caustic desulfonylation, and more specifically to in-situ regenerable caustic desulfonylation methods and systems.

BACKGROUND

Heavy oils and bitumens make up an increasing percentage of hydrocarbon resources. As the demand for hydrocarbon-based fuels has increased, a corresponding need has developed for improved processes for desulfurizing oil feed streams. Processes for the conversion of the heavy portions of these feed streams into more valuable, lighter fuel products have also taken on greater importance. These heavy oil feed streams include, but are not limited to, whole and reduced petroleum crudes, shale oils, coal liquids, atmospheric and vacuum residua, asphaltene, de-asphalted oils, cycle oils, FCC tower bottoms, gas oils, including atmospheric and vacuum gas oils and coker gas oils, light to heavy distillates including raw virgin distillates, hydrocrackers, hydrotreated oils, dewaxed oils, slack waxes, raffinates, and mixtures thereof.

Hydrocarbon streams having a boiling point above 220° C. often contain a considerable amount of large multi-ring hydrocarbon molecules and/or a conglomerated association of large molecules. These larger molecules and conglomerations often contain a large portion of the sulfur, nitrogen and metals in the hydrocarbon stream, which may be referred to as heteroatom contaminants in U.S. Pat. No. 8,764,973 to Litz et al., the contents of which are hereby incorporated by reference in its entirety, except where inconsistent with the content of the current disclosure. A significant portion of the sulfur contained in these heavy oils is in the form of heteroatoms in polycyclic aromatic molecules, comprised of sulfur compounds such as dibenzothiophenes, from which the sulfur is difficult to remove.

The processing of bitumens, crude oils, or other heavy oils with large numbers of multi-ring aromatics and/or asphaltenes can pose a variety of challenges. Conventional hydroprocessing methods can be effective at improving API for a heavy oil feed, but the hydrogen consumption can be substantial. Conversion of the liquid to less valuable products, such as coke, can be another concern with conventional techniques. Desulfurizing techniques and systems which have been disclosed by others including those systems described in U.S. Pat. No. 8,894,845 to Vann et al., U.S. Pat. No. 8,696,890 to Soto et al. and U.S. Pat. No. 8,673,132 to Leta et al., react unoxidized sulfur at high temperatures to cause thermal cracking reactions in oil. Cracking reactions convert unoxidized sulfur compounds to $H_2S$, resulting in the production of olefins and increases in the aromaticity which may be undesirable.

There is thus a need for a system and method for desulfurization that is capable of at least one of removing oxidized sulfur containing compounds such as sulfones, operating at lower temperatures to avoid thermal cracking reactions, producing non-ionizable hydrocarbon products while having reactants that are easily regenerated in-situ.

SUMMARY OF THE TECHNOLOGY

A first embodiment of this disclosure relates generally to a caustic desulfonylation system comprising: a reactor vessel with a solid carbonaceous selectivity promoter provided therein; a liquid feed input of the reactor vessel configured to receive a source of caustic, a hydrocarbon feed comprising oxidized sulfur containing compounds and; a gas feed input of the reactor vessel configured to receive a source of hydrogen; and an output of the reactor vessel, wherein said output releases the caustic, and an upgraded hydrocarbon product with a sulfur content less than the sulfur content of the hydrocarbon feed received by the liquid feed of the reactor vessel.

A second embodiment of this disclosure relates generally to a method for performing a caustic desulfonylation reaction comprising the steps of: providing a reactor vessel, said reactor vessel; placing, within the reactor vessel, a solid selectivity promoter made of carbonaceous material; receiving, by the reactor vessel, a hydrocarbon feed comprising a oxidized sulfur compound, a caustic and hydrogen gas; contacting the solid selectivity promoter with the hydrocarbon feed and caustic in the presence of hydrogen gas; producing an upgraded hydrocarbon product with a sulfur content less than the sulfur content of the hydrocarbon feed; and regenerating the selectivity promoter with the hydrogen gas.

DETAILED DESCRIPTION OF THE DISCLOSURE

Figure 1A:
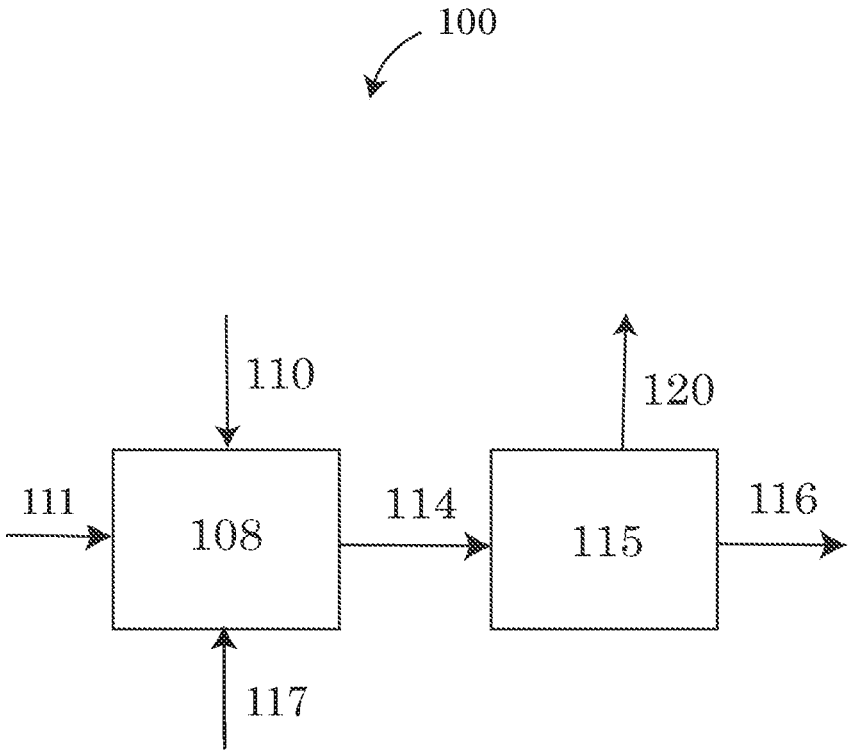
FIG. 1*a* depicts a flowchart describing an embodiment of a caustic desulfonylation treatment of a sulfone and/or sulfoxide rich hydrocarbon feed.

Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure. Reference will now be made in detail to certain embodiments of the disclosed methods and systems, examples of which are illustrated in part in the accompanying drawings and Examples below, which are provided for illustrative purposes intended for those skilled in the art and are not meant to be limiting in any way. For simplicity and clarity of illustration, reference numerals may be repeated among the figures to indicate corresponding or analogous elements.

As a preface to the detailed description, it should be noted that, as used in this specification and the appended claims, the singular forms "a", "an" and "the" include plural referents, unless the context clearly dictates otherwise.

Referring to the drawings, FIG. 1*a*, depicts a flow chart describing a system 100 and method for performing a caustic desulfonylation reaction consistent with the embodiments described herein. One or more alternative embodiments of the caustic desulfonylation system have been described and may be used as an alternative to the arrangement described in this application, so long as they are consistent with the disclosure here. For example, desulfonylation systems and equipment used to perform desulfonylation reactions described in U.S. Pat. Nos. 8,298,404 and 8,877,013 to Litz. et al., US Publication No. 2015/0337208 to Litz et al. and U.S. Pat. Nos. 8,197,671 and 8,894,843 to Rankin et al. are hereby incorporated by reference. Embodiments of the caustic desulfonylation systems and methods described herein may be performed within a reactor vessel 108. The reactor vessel 108 may be an oil/caustic reactor vessel, a promoted caustic visbreaker or a sulfone management unit in some embodiments. The reactor vessel 108 may be constructed out of any material suitable to withstand the basic conditions of the caustics being supplied to the reactor vessel 108. Examples of materials which may be suitable for constructing a reactor vessel may include iron, nickel, cobalt, and chromium based alloys and/or stainless steel alloys.

The reactor vessel 108 of the caustic desulfonylation system 100 may be configured to receive an oxidized hydrocarbon stream 111 comprising one or more oxidized sulfur containing species provided therein and/or one or more heteroatoms-containing hydrocarbons. Additional heteroatom containing compounds that may be present in the oxidized hydrocarbon stream may comprise oxidized sulfur components such as sulfoxide and sulfone rich hydrocarbons, as well as other compounds including, but not limited to those compounds comprising oxygen, nitrogen, nickel, vanadium, iron and other transition metals of the periodic table and combinations thereof. In some embodiments, the oxidized hydrocarbon stream 111 may be referred to as an oxidized heteroatom-containing hydrocarbon stream 111. The source of the oxidized hydrocarbon stream 111 may be connected to a liquid feed input (not shown) of the reactor vessel 108 allowing for the oxidized hydrocarbon stream to flow or be pumped into the reactor vessel 108 in either a metered or continuous fashion.

Inside the reactor vessel 108, the reactor vessel 108 may be provided with a solid selectivity promoter located therein. A solid selectivity promoter may refer to a substance in the solid state of matter that allows for a desulfonylation reaction to favor the production of reaction products that are non-ionizable hydrocarbon products and/or non-oxygenated hydrocarbon products. For example, the presence of a solid selectivity promoter in the reaction vessel 108 during a desulfonylation reaction may allow for the reaction to favor the production of biphenyl hydrocarbons as the dominant reaction product when dibenzothiophene sulfones are reacted. The solid selectivity promoter favors the non-ionized hydrocarbons over alternative reaction products formed by oxidized sulfur compounds such as ortho-phenyl phenolic compounds which may feature ionizable, oxygen containing hydrocarbon that may be the dominant reaction product when the solid selectivity promoter is not present. Embodiments of the solid selectivity promoter may be any solid substance that is chemically stable under the harsh basic conditions of the desulfonylation reaction and under temperatures up to about 350° C. In the exemplary embodiment, the solid selectivity promoter may be a carbonaceous material including but not limited to activated carbon, graphite, graphene, coal or asphaltenes or combinations thereof.

Embodiments of the solid selectivity promoter may be advantageous over selectivity promoters provided as a liquid or in solution because a solid selectivity promoter may remain inside the reactor vessel 108 both during and after the desulfonylation reaction has completed. Carbonaceous materials have excellent chemical resistance, and very high melting points. Carbonaceous materials are rarely used as catalysts for reactions, but a solid carbonaceous material may be more effective than comparative liquid selectivity promoters and have the ability to be regenerated in-situ by hydrogen which is unusual, unexpected and highly beneficial. The carbonaceous material disclosed herein effectively promotes the selectivity of the reaction to more valuable, non-ionizable hydrocarbons (e.g. dibenzothiophene sulfone to biphenyl).

Using a solid selectivity promoter and allowing it to remain inside the reactor vessel 108 may be advantageous over liquid or solutions comprising a selectivity promoter. Liquids and solutions comprising selectivity promoters may be eluted from the reactor vessel during the desulfonylation reaction, and may require further separation and recycling steps. Instead of being removed from the reactor vessel 108 and require further separation and recycling, a solid selectivity promoter may be regenerated inside the reactor vessel 108. In some embodiments, the solid selectivity promoter may further be advantageous because the solid selectivity promoter may be continuously regenerated in-situ during the desulfonylation reaction, ensuring that that the solid selectivity promoter may not be entirely used up during a continuous desulfonylation reaction.

Embodiments of the solid selectivity promoter may be regenerated by contacting the solid selectivity promoter with hydrogen gas 117. For example, in some embodiments of the desulfonylation system 100 described herein, the interior of the reactor vessel 108 containing the solid selectivity promoter may be pressurized with hydrogen gas 117. Embodiments of the reactor vessel 108 may include a gas feed input connected to a source of hydrogen gas 117. The hydrogen gas 117 may subsequently be metered or pumped into the reactor vessel 108 through the gas feed input until the reactor vessel has been pressurized. The pressure of the hydrogen provided within the reactor vessel 108 may range from atmospheric pressure up to about 1000 psig in some embodiments and more specifically between about 400-600 psig in alternative embodiments. In the exemplary embodiments the reactor vessel 108 may be provided with hydrogen gas to a pressure of about 200-500 psig.

Embodiments of the desulfonylation system may further comprise a caustic compound 110 being provided to the reactor vessel 108 in order to perform a desulfonylation reaction. The embodiments of the caustic compound 110 may be provided to the reactor vessel 108 by connecting a source of a caustic compound 110 to a liquid feed input of the reactor vessel 108. In some embodiments, the liquid feed receiving the caustic compound 110 may be a separate liquid feed from the liquid feed input receiving the oxidized hydrocarbon stream 111. In those instances where the caustic compound 110 and the oxidized hydrocarbon stream 111 each enter the reactor vessel 108 at a different liquid feed input, the liquid feed input may be referred to as a first liquid feed input, second liquid feed input, etc.

Embodiments of the caustic compound 110 being delivered to the liquid feed input of the reactor vessel 108 may be any inorganic compound that exhibits basic properties. Inorganic basic compounds may include, but are not limited to, inorganic oxides from group IA and IIA elements of the periodic table, inorganic hydroxides from group IA and IIA elements, or optionally mixtures of oxides and hydroxides of group IA and IIA elements, molten hydroxides of group IA and IIA elements, or optionally mixtures of hydroxides of said elements. Specific examples of the caustic compound (optionally at about 50% weight in water) may include $Li_2O$, $Na_2O$, $K_2O$, $Rb_2O$, $Cs_2O$, $Fr_2O$, $B_2O$, MgO, CaO, SrO, BaO, and the like as well as LiOH, NaOH, KOH, RbOH, CsOH, FrOH, $Be(OH)_2$, $Mg(OH)_2$, $Ca(OH)_2$, $Sr(OH)_2$, $Ba(OH)_2$, green liquor, mixtures or molten mixtures thereof.

As shown in FIG. 1*a*, a desulfonylation reaction may occur when the reactants comprising the oxidized hydrocarbon stream 111 and the caustic 110 each enter the reactor vessel 108 where they mix under the pressure of the hydrogen gas 117 and make contact with the solid selectivity promoter present in the reactor vessel 108. The temperature of the reaction vessel 108 may be maintained during the desulfonylation reaction at approximately about 200-500° C. and in the exemplary embodiments between about 275-300° C. As a result of the desulfonylation reaction, a mixture of one or more reaction products may exit the reactor vessel 108 via route 114 of the desulfonylation system 100, from an output of the reaction vessel 108. The mixture of one or more reaction products exiting the reactor vessel 108 may include an upgraded hydrocarbon product 120 which may be non-ionized hydrocarbon product, as well as the caustic, water, unconsumed hydrogen gas and sulfur containing compounds, Not intending to be bound by any particular theory, the following net equation generally describes an example of the reagents used and products observed:

$$2NaOH+R(SO2)R'+H_2 \rightarrow H_2O+Na_2SO_3+R—H+R'—H.$$

In some embodiments, R and R' may even be further linked as part of a heterocyclic structure, for instance in the example of this reaction provided below:

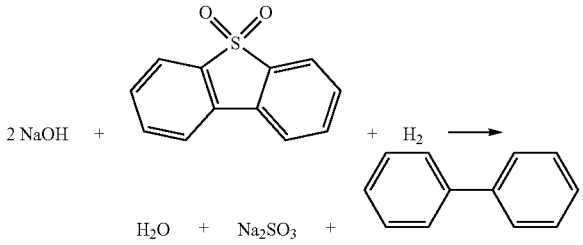

In some embodiments, the mixture of reaction products exiting the output of the reaction vessel via route 114 may further be sent to a separating vessel 115. The separating vessel 115 may be a gravity settler in some embodiments. Inside the separating vessel 115, upgraded hydrocarbon product 120 may separate into a light phase while the water, sulfur containing compounds, residual caustic and reaction by-products may separate into a heavier dense phase 116. Subsequently, the light phase comprising the upgraded hydrocarbon products 120 can be removed and isolated from the dense phase 116. In alternative embodiments, the reaction vessel 108 may also serve as the separating vessel 115.

In some embodiments, upgraded hydrocarbon products 120 obtained and separated from the separator vessel 115 may be further washed, refined or utilized for gas, oil, fuel, lubricants or other hydrocarbon based products and further treated using known refinery processes. In some embodiments, the upgraded hydrocarbon product 120 may further be washed to remove traces of reaction by-products that may not have fully separated into the dense phase. The removal of the traces of the reaction by-products such as sulfur containing compounds, and excess caustic may be removed using methods including, but not limited to, solvent extraction, washing with water, centrifugation, distillation, vortex separation, and membrane separation and/or combinations thereof. Trace quantities of caustic may also be removed using electrostatic desalting and dewatering techniques according to known methods by those skilled in the art.

Figure 1B:
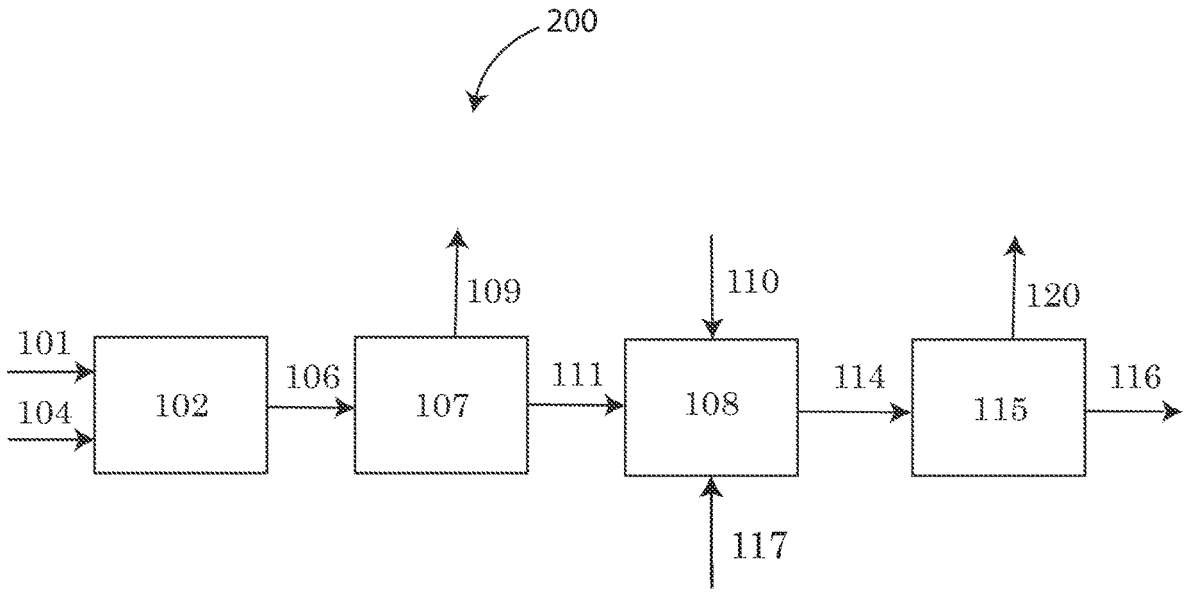
FIG. 1*b* depicts a flow chart of an embodiment of oxidative desulfurization of a hydrocarbon feed using embodiments of caustic desulfonylation.

Referring to FIG. 1*b*, in some embodiments the desulfonylation system 100 shown in FIG. 1*a* may be further incorporated into an oxidative desulfurization system 200 performing one or more oxidation steps to a hydrocarbon stream 101 prior to becoming the oxidized hydrocarbon stream 111 entering the reactor vessel 108. The hydrocarbon stream 101 may be combined with an oxidant 104 and subjected to an oxidation reaction inside an oxidizer vessel 102. Embodiments of the oxidation step may be carried out using at least one oxidant, optionally in the presence of a catalyst. Suitable oxidants 104 may include organic peroxides, hydroperoxides, hydrogen peroxide, $O_2$, air, $O_3$, peracetic acid, organic hydroperoxides may include benzyl hydroperoxide, ethylbenzene hydroperoxide, tert-butyl hydroperoxide, cumyl hydroperoxide and mixtures thereof, other suitable oxidants may include sodium hypochlorite, permanganate, biphasic hydrogen peroxide with formic acid, nitrogen containing oxides (e.g. nitrous oxide), and mixtures thereof, with or without additional inert organic solvents.

In an alternative embodiment, the step of oxidation may further include an acid treatment (not shown) including at least one immiscible acid. The immiscible acid and oxidant treatment may remove a portion of the heteroatom contaminants from the feed, wherein upon being oxidized by the immiscible acid and oxidant, the heteroatoms may become soluble in the acid phase, and be subsequently removed via a heteroatom containing by-product stream. The immiscible acid used may be any acid which is insoluble in the hydrocarbon oil phase. Suitable immiscible acids may include, but are not limited to, carboxylic acids, sulfuric acid, hydrochloric acid, and mixtures thereof, with or without varying amounts of water as a diluent. Suitable carboxylic acids may include, but are not limited to, formic acid, acetic acid, propionic acid, butyric acid, lactic acid, benzoic acid, and the like, and mixtures thereof, with or without varying amounts of water as a diluent.

In some embodiments, the oxidation reaction(s) may be carried out at a temperature of about 20° C. to about 120° C., at a pressure of about 0.1 atmospheres to about 10 atmospheres, with a contact time of about 2 minutes to about 180 minutes.

A catalyst may be used in the presence of the oxidant 104. A suitable catalyst may include transition metals including but not limited to Ti(IV), V(V), Mo(VI), W(VI), transition metal oxides, including ZnO, $Al_2O_3$, CuO, layered double hydroxides such as $ZnAl_2O_4.x(ZnO)y(Al_2O_3)$, organometallic complexes such as $Cu_xZn_{1-x}Al_2O_4$, zeolite, $Na_2WO_4$, transition metal aluminates, metal alkoxides, such as those represented by the formula $M_mO_m(OR)_n$, and polymeric formulations thereof, where M is a transition metal such as, for example, titanium, rhenium, tungsten, copper, iron, zinc or other transition metals, R may be a carbon group having at least 3 carbon atoms, where at each occurrence R may individually be a substituted alkyl group containing at least one OH group, a substituted cycloalkyl group containing at least one OH group, a substituted cycloalkylalkyl group containing at least one OH group, a substituted heterocyclyl group containing at least one OH group, or a heterocyclylalkyl containing at least one OH group. The subscripts m and n may each independently be integers between about 1 and about 8. In some embodiments, R may be substituted with halogens such as F, Cl, Br, and I. For example, embodiments of the metal alkoxide catalyst may include bis(glycerol)oxotitanium(IV)), wherein M is Ti, m is 1, n is 2, and R is a glycerol group. Other examples of metal alkoxides include bis(ethyleneglycol)oxotitanium (IV), bis (erythritol)oxotitanium (IV), bis(sorbitol)oxotitanium (IV).

The sulfoxidation catalyst may further be bound to a support surface. The support surface may include an organic polymer or an inorganic oxide. Suitable inorganic oxides include, but are not limited to, oxides of elements of groups IB, II-A, II-B, III-A, III-B, IV-A, IV-B, V-A, V-B, VI-B, of the Periodic Table of the Elements. Examples of oxides that may be used as a support include copper oxides, silicon dioxide, aluminum oxide, and/or mixed oxides of copper, silicon and aluminum. Other suitable inorganic oxides which may be used alone or in combination with the abovementioned oxide supports may be, for example, MgO, $ZrO_2$, $TiO_2$, CaO and/or mixtures thereof. Other supports may include talc.

The support materials used may have a specific surface area in the range from 10 to 1000 $m^2/g$, a pore volume in the range from 0.1 to 5 ml/g and a mean particle size of from 0.1 to 10 cm. Preference may be given to supports having a specific surface area in the range from 0.5 to 500 $m^2/g$, a pore volume in the range from 0.5 to 3.5 ml/g and a mean particle size in the range from 0.5 to 3 cm. Particular preference may be given to supports having a specific surface area in the range from 200 to 400 $m^2/g$, and a pore volume in the range from 0.8 to 3.0 ml/g.

After subjecting the hydrocarbon stream 101 to oxidation conditions in the oxidizer vessel 102, an intermediate stream 106 may be generated. A hydrocarbon feed 101 containing, for example sulfur-based heteroatom contaminants such as thiophenes, benzothiophenes, dibenzothiophenes and thioethers and others may be converted to a sulfone or sulfoxide rich intermediate stream 106. The intermediate hydrocarbon stream 106 may include oxidized heteroatom containing compounds and oxidant by-products. In some embodiments, the intermediate stream 106 may be subjected to distillation 107, for example in a distillation column. During distillation 107, the oxidized heteroatom containing compounds, may be separated from the oxidant by-products 109. The oxidant by-products may be recovered and recycled. As a result of the distillation 107, an oxidized hydrocarbon stream 111 may be formed including oxidized sulfur compounds such as sulfones and sulfoxide rich hydrocarbons. The sulfone and sulfoxide rich hydrocarbon stream 111 may be sent to the reactor vessel 108 to perform the desulfonylation reaction as described above.

Embodiments of methods for performing a caustic desulfonylation reaction, consistent with the desulfonylation system described above may be performed in accordance with the steps described herein. For instance, in some embodiments, the method for performing the caustic desulfonylation reaction may include the step of providing the reactor vessel 108 and placing within the reactor vessel a solid selectivity promoter, such as a solid selectivity promoter made of a carbonaceous material. Embodiments of the method steps may further include the step of receiving, by the reactor vessel 108, a caustic and/or hydrogen gas and an oxidized hydrocarbon feed 111 comprising one or more heteroatom containing compounds which may include oxidized sulfur compounds.

As the reactor vessel 108 is continuously or in a metered fashion, receiving the oxidized hydrocarbon feed 111, caustic 110 and hydrogen gas 117, the oxidized hydrocarbon feed 111, caustic 110 and hydrogen gas 117 may be contacting the solid selectivity promoter. As result of the oxidized hydrocarbon feed 111 and caustic 110 contacting one another in the presence of the solid selectivity promoter, the resulting desulfonylation reaction may be producing an upgraded hydrocarbon product 120 having a reduced heteroatom content. More specifically, the upgraded hydrocarbon product 120 produced may have a sulfur content that is less that the sulfur content of the oxidized hydrocarbon feed 111. Moreover, the resulting upgraded hydrocarbon product 120 produced may be non-ionized hydrocarbon products as described above.

Furthermore, in some embodiments, as the desulfonylation system is performing the desulfonylation reaction inside the reactor vessel 108, simultaneously, or near simultaneously, the hydrogen gas 117 entering the reactor vessel 108 may be continuously regenerating the solid selectivity promoter being utilized as a desulfonylation reactant. In some embodiments, the regenerating step may also be performed by exposing the solid selectivity promoter inside the reactor vessel 108 to the hydrogen gas 117 after the desulfonylation reaction is performed.

The following working examples are provided for illustrative purposes. The working examples are intended to be non-limiting and are intended to further explain and assist in clarifying one or more of the elements of the embodiments described above in the current disclosure:

Example 1. Desulfurization of Sulfoxidized Bitumen

A 1000 mL reactor made of nickel was filled with 43.6 grams of activated carbon (3.6 moles), 45.7 grams of 50% sodium hydroxide in water, 125.7 grams of a bitumen oil containing 4.54% by weight of sulfur which had been previously subjected to sulfoxidation to convert sulfur species to sulfones (0.09 moles sulfones), and 26.6 grams of toluene as a solvent. The reactor was purged with nitrogen gas and then pressurized with 150 psig hydrogen gas (0.32 moles). The reactor was heated to 300° C. and stirred at 600 RPM for 90 minutes. The reactor was then cooled and the oil contents centrifuged to remove any caustic, activated carbon, or reaction by-products. The centrifuged oil was analyzed for sulfur content and density. The sulfur content of the bitumen was reduced by 47% from 4.54% wt sulfur to 2.41% wt sulfur. The density of the bitumen before sulfoxidation was 1.009 g/mL at 15° C., which dropped to 0.9746 g/mL at 15° C. after treatment.

Example 2. Desulfurization of Dibenzothiophene Sulfone

A 300 mL reactor made of nickel was filled with 17.1 grams of activated carbon (1.4250 moles), 17.1 grams of 50% sodium hydroxide in water, 7.7 grams of dibenzothiophene sulfone (0.0356 moles), and 50.2 grams 1,2,4-trimethylbenzene as a solvent. The reactor was purged with nitrogen gas and then pressurized with 200 psig hydrogen gas (0.12 moles). The reactor was heated to 300° C. and stirred at 600 RPM for 90 minutes. The reactor was then cooled and the product was analyzed by HPLC. All of the initial dibenzothiophene sulfone had been converted, with 33.7 mole percent converted to biphenyl and 7.95 mole percent converted to ortho-phenylphenol.

Comparative Example 1. Desulfurization of Dibenzothiophene

An experiment was performed as in example 2, except that an un-sulfoxidized sulfur compound (dibenzothiophene) was used in place of a sulfone compound. A 300 mL reactor made of nickel was filled with 16.9 grams of activated carbon (1.4083 moles), 17.0 grams of 50% sodium hydroxide in water, 6.4 grams of dibenzothiophene (0.0348 moles), and 51.5 grams 1,2,4-trimethylbenzene as a solvent. The reactor was purged with nitrogen gas and then pressurized with 200 psig hydrogen gas (0.12 moles). The reactor was heated to 300° C. and stirred at 600 RPM for 90 minutes. The reactor was then cooled and the product was analyzed by HPLC. Only dibenzothiophene was recovered. The HPLC did not detect any reaction products.

Comparative Example 2. Desulfurization of Dibenzothiophene Sulfone without Carbon Present An experiment was performed as in example 2, but without activated carbon present. A 300 mL reactor made of nickel was filled with 20.1 grams of 50% sodium hydroxide in water, 9.0 grams of dibenzothiophene sulfone (0.0147 moles), and 53.5 grams 1,2,4-trimethylbenzene as a solvent. The reactor was purged with nitrogen gas and then pressurized with 200 psig hydrogen gas (0.12 moles). The reactor was heated to 300° C. and stirred at 600 RPM for 90 minutes. The reactor was then cooled and the product was analyzed by HPLC. 13.87 mole percent of the initial dibenzothiophene sulfone had been converted, with 4.06 mole percent converted to ortho-phenylphenol and 0 mole percent converted to biphenyl.

Comparative Example 3. Desulfurization of Un-Sulfoxidized Bitumen

An experiment was performed as in example 1, but the bitumen was not subjected to sulfoxidation, so the sulfur in the oil had not been converted to sulfones. A 300 mL reactor made of nickel was filled with 15.0 grams of activated carbon (1.25 moles), 15.5 grams of 50% sodium hydroxide in water, 48.6 grams of a bitumen oil containing 4.54% by weight of sulfur (0.0690 moles sulfur), and 11.8 grams of toluene as a solvent. The reactor was purged with nitrogen gas and then pressurized with 200 psig hydrogen gas (0.14 moles). The reactor was heated to 300° C. and stirred at 600 RPM for 90 minutes. The reactor was then cooled and the oil contents centrifuged to remove any caustic, activated carbon, or reaction by-products. The centrifuged oil was analyzed for sulfur content and density. The sulfur content of the bitumen was only decreased by 5% from 4.54% wt sulfur to 4.32% wt sulfur.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A system comprising:

an oxidizer vessel for oxidizing a hydrocarbon stream and thereby generating an intermediate stream;

a distillation column for separating oxidized heteroatom containing compounds from the intermediate stream and thereby generating a distilled oxidized hydrocarbon stream; and a reactor vessel for housing a desulfonylation reaction of the distilled oxidized hydrocarbon stream inside the reactor vessel, the reactor vessel configured such that when the desulfonylation reaction of the distilled oxidized hydrocarbon stream takes place inside the reactor vessel:

a solid selectivity promoter remains inside the reactor vessel while the desulfonylation reaction of the distilled oxidized hydrocarbon stream takes place inside the reactor vessel; and the solid selectivity promoter is regenerated while the desulfonylation reaction of the distilled oxidized hydrocarbon stream takes place inside the reactor vessel.

2. The system of claim 1, further comprising:

a separating vessel;

wherein the desulfonylation reaction of the distilled oxidized hydrocarbon stream results in an upgraded hydrocarbon product; and wherein the separating vessel separates the upgraded hydrocarbon product into a light phase.

3. The system of claim 1, wherein the solid selectivity promoter comprises at least one of activated carbon, graphite, graphene, coal, and an asphaltene.

4. The system of claim 1, wherein an interior of the reactor vessel is pressurized with a hydrogen gas.

5. The system of claim 4, wherein the interior of the reactor vessel is pressurized with the hydrogen gas to a pressure of at least 200 psig.

6. The system of claim 1, wherein a caustic is used in the desulfonylation reaction of the distilled hydrocarbon stream and wherein the caustic comprises an inorganic basic compound.

7. The system of claim 6, wherein the inorganic basic compound includes at least one of: an inorganic oxide from a group IA or IIA element, an inorganic hydroxide from a group IA or IIA element, a mixture of oxides and hydroxides from group IA or IIA elements, a molten hydroxide from a group IA or IIA element, and a mixture of hydroxides from group IA or IIA elements.

8. The system of claim 6, wherein the caustic comprises the inorganic basic compound at about 50% weight in water.

9. The system of claim 6, wherein the caustic comprises at least one of: $Li_2O$, $Na_2O$, $K_2O$, $Rb_2O$, $Cs_2O$, $Fr_2O$, $B_2O$, MgO, CaO, SrO, BaO, LiOH, NaOH, KOH, RbOH, CsOH, FrOH, $Be(OH)_2$, $Mg(OH)_2$, $Ca(OH)_2$, $Sr(OH)_2$, $Ba(OH)_2$, and green liquor.

10. The system of claim 1, wherein the intermediate stream comprises the oxidized heteroatom containing compounds and wherein the oxidized heteroatom containing compounds are formed by oxidizing the hydrocarbon stream with an oxidant in the oxidizer vessel.

11. The system of claim 10, wherein the oxidized heteroatom containing compounds are also formed by an acid treatment.

12. The system of claim 10, wherein a catalyst is used in the presence of the oxidant.

13. The system of claim 12, wherein the catalyst is bound to a support surface.

14. The system of claim 13, wherein the support surface comprises one of an organic polymer and an inorganic oxide.

15. The system of claim 4, wherein the hydrogen gas regenerates the solid selectivity promoter.

* * * * *